US008407941B2

(12) United States Patent
Chang et al.

(10) Patent No.: US 8,407,941 B2
(45) Date of Patent: Apr. 2, 2013

(54) DRIVING DEVICE FOR DRIVING TWO DOOR PANELS TO SYNCHRONOUSLY MOVE

(75) Inventors: Wei-Hung Chang, Taichung (TW); Sung-Hui Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 143 days.

(21) Appl. No.: 13/047,476

(22) Filed: Mar. 14, 2011

(65) Prior Publication Data

US 2012/0233926 A1 Sep. 20, 2012

(51) Int. Cl.
*E05F 11/04* (2006.01)

(52) U.S. Cl. ..... 49/409; 49/425; 49/116

(58) Field of Classification Search ..... 49/425, 49/409, 410, 116, 118, 123
See application file for complete search history.

(56) References Cited

U.S. PATENT DOCUMENTS

| | | | | | |
|---|---|---|---|---|---|
| 2,680,875 | A * | 6/1954 | Coffey | 16/105 |
| 2,754,535 | A * | 7/1956 | Plemeng | 16/87 R |
| 2,999,267 | A * | 9/1961 | Sterling et al. | 16/105 |
| 3,058,173 | A * | 10/1962 | Brydolf | 49/411 |
| 3,457,676 | A * | 7/1969 | Ziegler | 49/409 |
| 3,553,890 | A * | 1/1971 | Stretton | 49/32 |
| 3,555,612 | A * | 1/1971 | Procton | 16/105 |
| 3,683,551 | A * | 8/1972 | Martindill | 49/4 |
| 3,872,622 | A * | 3/1975 | Berk | 49/118 |
| 4,698,876 | A * | 10/1987 | Karita | 16/102 |
| 4,735,292 | A * | 4/1988 | Munz | 187/324 |
| 4,887,394 | A * | 12/1989 | Marlowe | 49/409 |
| 5,070,575 | A * | 12/1991 | Redman et al. | 16/96 R |
| 5,247,763 | A * | 9/1993 | Hein | 49/31 |
| 5,450,693 | A * | 9/1995 | Tarrega | 49/411 |
| 5,598,666 | A * | 2/1997 | Kurth | 49/409 |
| 5,659,160 | A * | 8/1997 | Tracey | 187/316 |
| 5,711,112 | A * | 1/1998 | Barten et al. | 49/118 |
| 5,755,060 | A * | 5/1998 | Zweili | 49/449 |
| 6,233,878 | B1 * | 5/2001 | Krahenbuhl et al. | 52/64 |
| 6,336,247 | B1 * | 1/2002 | Schnoor | 16/87.6 R |
| 6,381,904 | B1 * | 5/2002 | Tedescucci | 49/409 |
| 6,820,371 | B1 * | 11/2004 | Park | 49/425 |
| 6,865,848 | B2 * | 3/2005 | Krimmel | 49/409 |
| 6,912,812 | B2 * | 7/2005 | Inage | 49/409 |
| 7,065,831 | B2 * | 6/2006 | Elmer | 16/91 |
| 7,137,172 | B2 * | 11/2006 | Elmer | 16/105 |
| 7,246,688 | B2 * | 7/2007 | Tonna et al. | 187/324 |
| 7,367,159 | B2 * | 5/2008 | Delgado et al. | 49/120 |
| 7,568,311 | B2 * | 8/2009 | Shivak et al. | 49/409 |
| 7,637,059 | B2 * | 12/2009 | Chang et al. | 49/425 |

(Continued)

*Primary Examiner* — Katherine Mitchell
*Assistant Examiner* — Justin Rephann
(74) *Attorney, Agent, or Firm* — Hershkovitz & Associates, LLC; Abraham Hershkovitz

(57) ABSTRACT

A driving device for driving two door panels to synchronously move has a rail rod, an endless cord and multiple clamping assemblies. The endless cord is parallel to the rail rod and is mounted at a position at inner sides of the door panels. The clamping assemblies are securely connected to the cord, are moveable relative to the rail rod and clamp the door panels. Each clamping assembly has a front clamping panel and a rear clamping panel. The front clamping panel is mounted on an outer side of a corresponding one of the door panels. The rear clamping panel is mounted on the inner side of the corresponding door panel and is connected securely to the front clamping panel and the cord. Accordingly, the conjunction positions between clamping assemblies and a cord are hidden by the inner sides of the door panels.

11 Claims, 7 Drawing Sheets

U.S. PATENT DOCUMENTS

| | | | | |
|---|---|---|---|---|
| 7,730,670 | B2 * | 6/2010 | Whitaker | 49/409 |
| 7,757,437 | B2 * | 7/2010 | Schulte et al. | 49/141 |
| 7,841,048 | B2 * | 11/2010 | Tsai | 16/91 |
| 2003/0172592 | A1 * | 9/2003 | Krimmel | 49/409 |
| 2005/0150169 | A1 * | 7/2005 | Schulte et al. | 49/410 |
| 2009/0000204 | A1 * | 1/2009 | Chang et al. | 49/425 |
| 2009/0145039 | A1 * | 6/2009 | Shehoski | 49/409 |
| 2010/0307063 | A1 * | 12/2010 | Bouthillier | 49/425 |

* cited by examiner

DRIVING DEVICE FOR DRIVING TWO DOOR PANELS TO SYNCHRONOUSLY MOVE

BACKGROUND OF THE INVENTION

1. Field of the Invention

The present invention relates to a driving device, and more particularly to a driving device for driving two door panels to synchronously move.

2. Description of Related Art

A driving device is always mounted between two door panels to drive the door panel to synchronously move toward or away from each other so as to close or open the door panels. With reference to FIG. 7, a conventional driving device comprises an endless cord 40, a driving assembly and multiple holding arms 42. The driving assembly is connected to the cord 40 to drive the cord 40 to endlessly move. The holding arms 42 are connected securely to the cord 40 and clamp edges of two door panels. Accordingly, when the cord 40 is driven to move by the driving assembly, the door panels are moved by the cord 40 with the transmission of the holding arms 42 to close or open the door panels.

However, the cord 40 and the holding arms 42 of the conventional driving device are mounted on positions at the outer sides of the door panels, so the arrangement of the conventional driving device will badly influence the aesthetic appearance of the door panels. In addition, the holding arms 42 of the conventional driving device are integral structures and are not adjustable to fit with different needs and conditions. Accordingly, the costs for assembling and manufacturing the conventional driving device are relative high.

To overcome the shortcomings, the present invention tends to provide a driving device to mitigate or obviate the aforementioned problems.

SUMMARY OF THE INVENTION

The main objective of the invention is to provide a driving device for driving two door panels to synchronously move to make the conjunction positions between clamping assemblies and a cord hidden by the inner sides of the door panels so as to reduce bad influence to the aesthetic appearance of the door panel.

The driving device has a rail rod, an endless cord and multiple clamping assemblies. The endless cord is parallel to the rail rod and is adapted to be mounted at a position at inner sides of the door panels. The clamping assemblies are securely connected to the cord, are moveable relative to the rail rod and are adapted to clamp the door panels. Each clamping assembly comprises a front clamping panel and a rear clamping panel. The front clamping panel is adapted to be mounted on an outer side of a corresponding one of the door panels. The rear clamping panel is adapted to be mounted on the inner side of the corresponding door panel and is connected securely to the front clamping panel and the cord.

Other objects, advantages and novel features of the invention will become more apparent from the following detailed description when taken in conjunction with the accompanying drawings.

DETAILED DESCRIPTION OF PREFERRED EMBODIMENT

Figure 1:
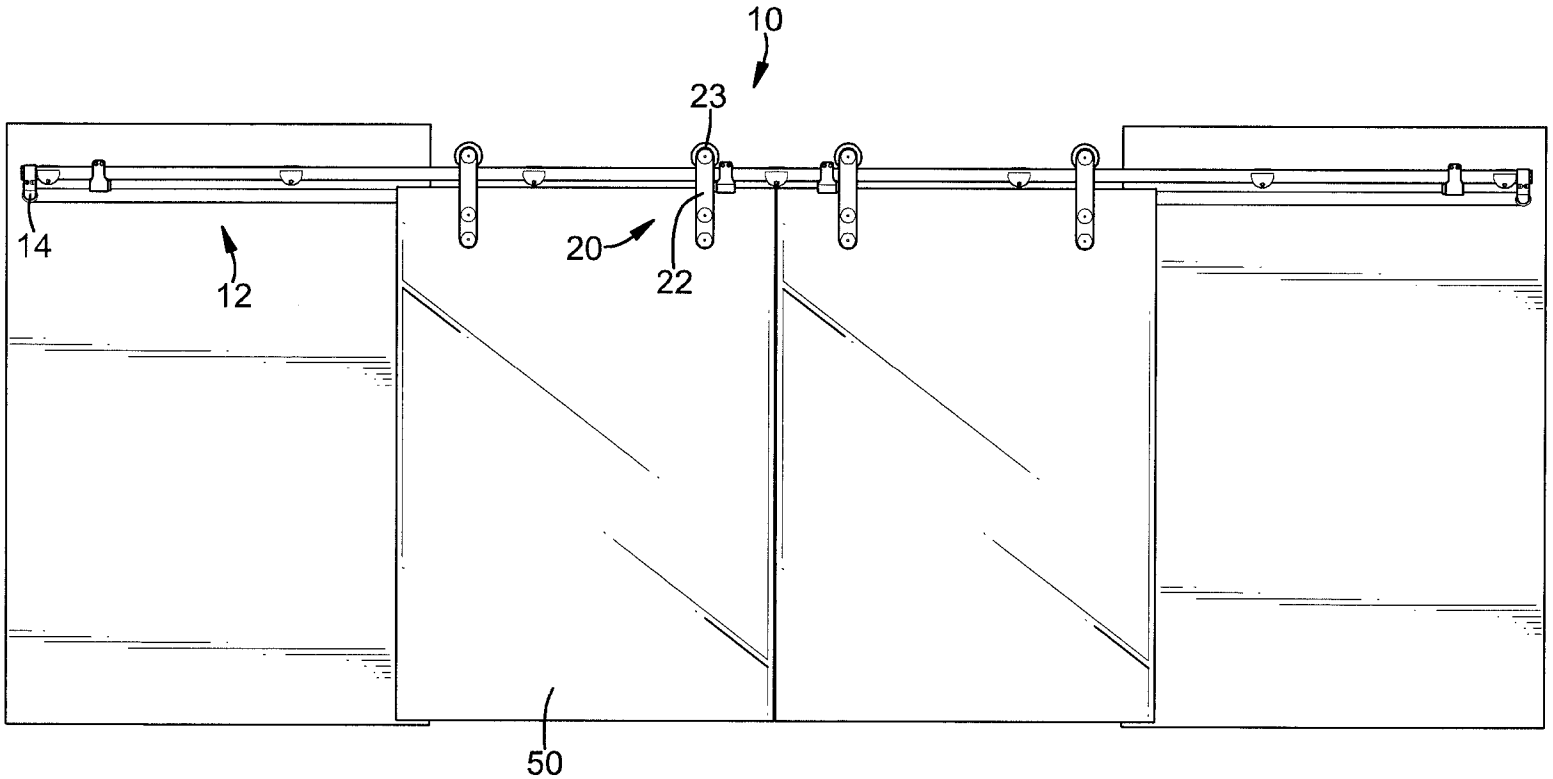
FIG. 1 is a front view of a driving device in accordance with the present invention mounted on two door panels.
Figure 2:
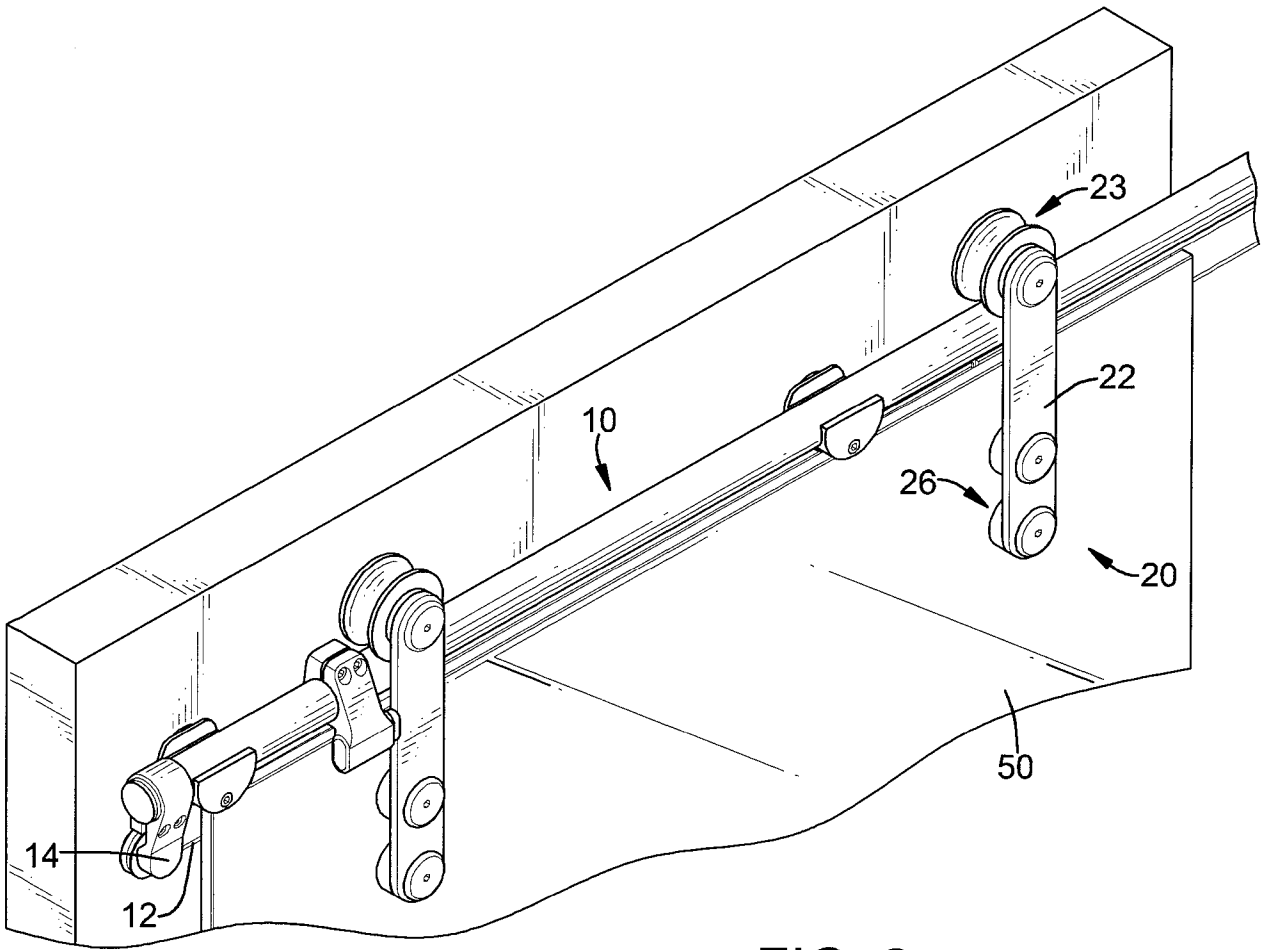
FIG. 2 is an enlarged partial perspective view of the driving device in FIG. 1.
Figure 3:
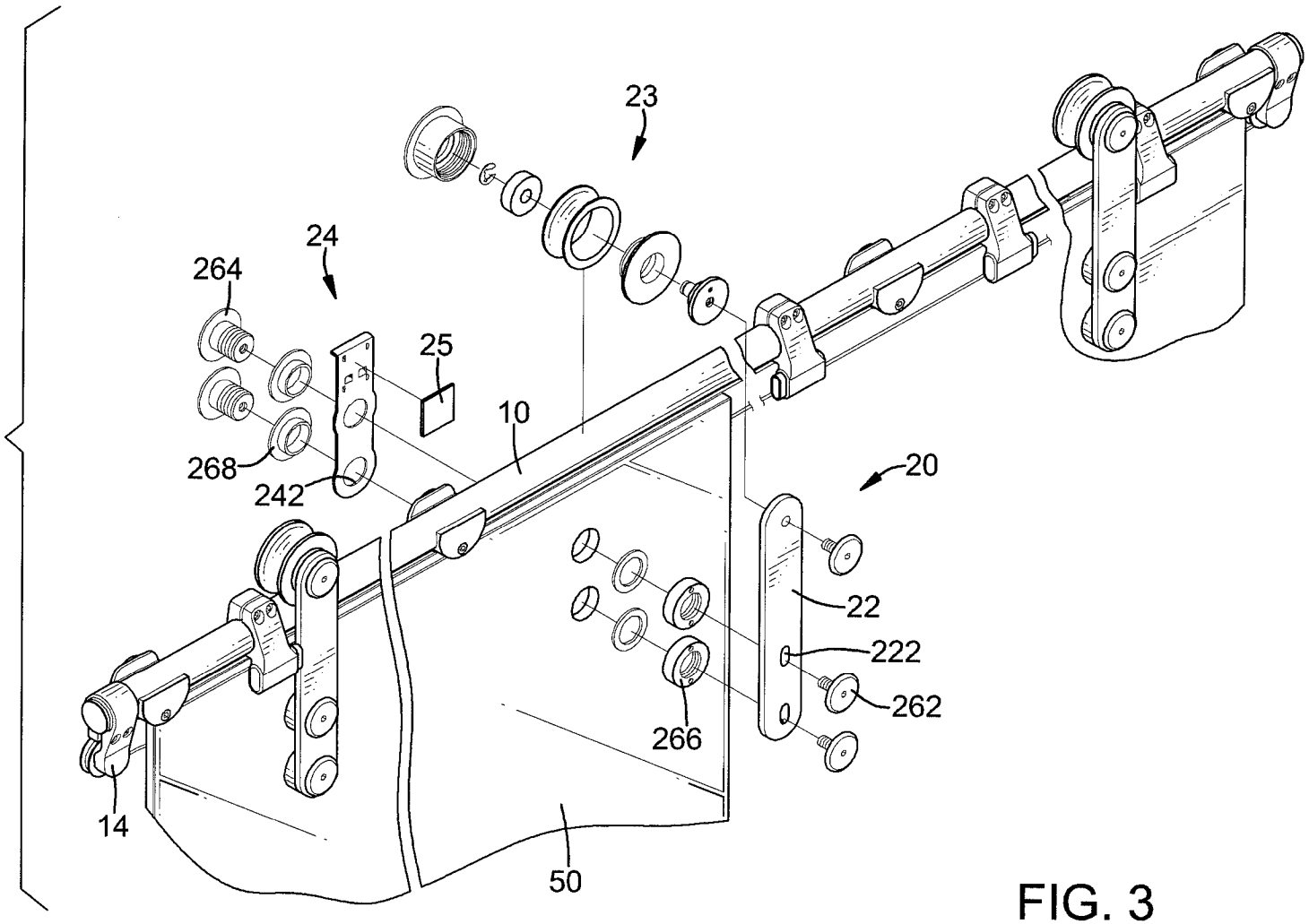
FIG. 3 is an enlarged exploded perspective view of the driving device in FIG. 1.

With reference to FIGS. 1 to 3, a driving device for driving two door panels to synchronously move in accordance with the present invention comprises a rail rod 10, a cord 12 and multiple clamping assemblies 20. The rail rod 10 is mounted at a position at inner sides of the door panels 50 and has two wheels 14 mounted respectively on two ends of the rail rod 10. The cord 12 is endlessly mounted between and around the wheels 14 on the rail rod 10, is parallel to the rail rod 10 and is mounted at a position at the inner sides of the door panels 50. Preferably, the cord 12 is at a position below the rail rod 10, and the endless cord 12 is divided into an upper segment and a lower segment.

The clamping assemblies 20 are securely connected to the cord 12, are moveable relative to the rail rod 10 and securely clamp the door panels 50. Each clamping assembly 20 comprises a front clamping panel 22, a rear clamping panel 24 and at least one fastener assembly 26. The front clamping panel 22 is elongated and is mounted on the outer side of a corresponding one of the door panels 50. The front clamping panel 22 may have a roller 23 rotatably mounted on a top at an inner side of the front clamping panel 22 and mounted over a top of the rail rod 10. With the arrangement of the roller 23, the clamping assembly 20 is moveable relative to the rail rod 10 smoothly. In addition, the front clamping panel 22 further has at least one through hole 222 defined through the front clamping panel 22 near a bottom of the front clamping panel 22, and the at least one through hole 222 may be elongated.

Figure 4:
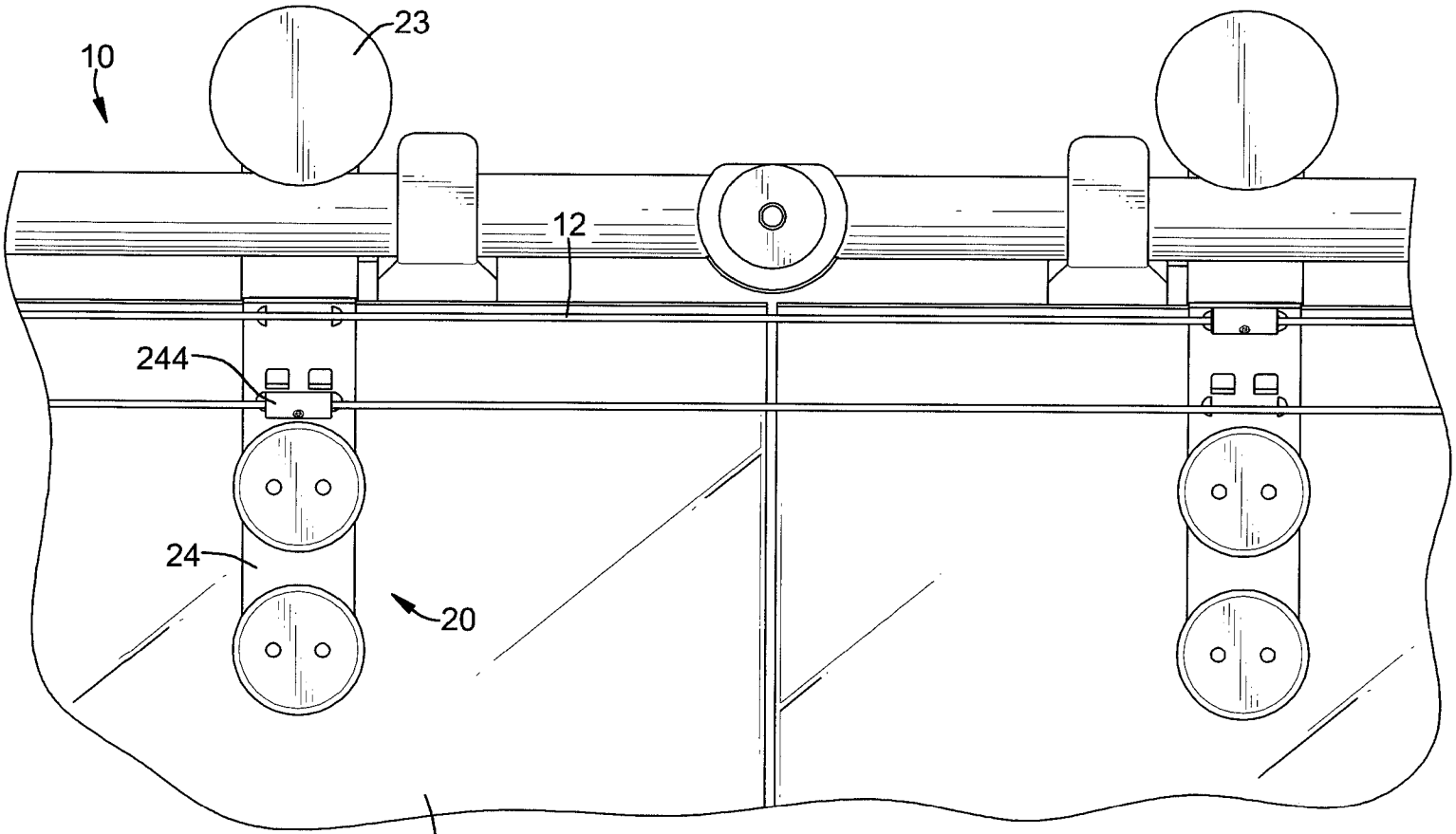
FIG. 4 is an enlarged rear view of the driving device in FIG. 1.
Figure 5:
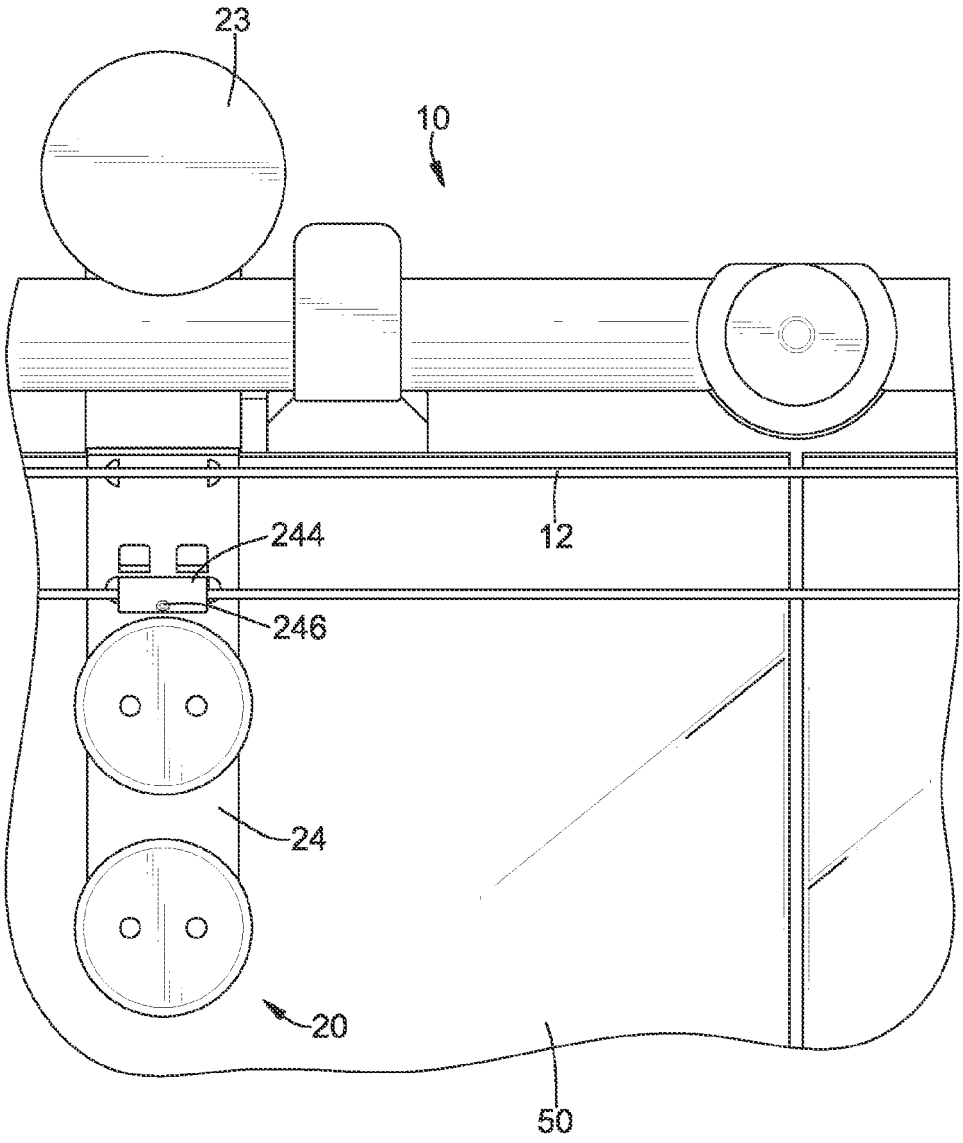
FIG. 5 is another enlarged rear view of the driving device in FIG. 1.
Figure 6:
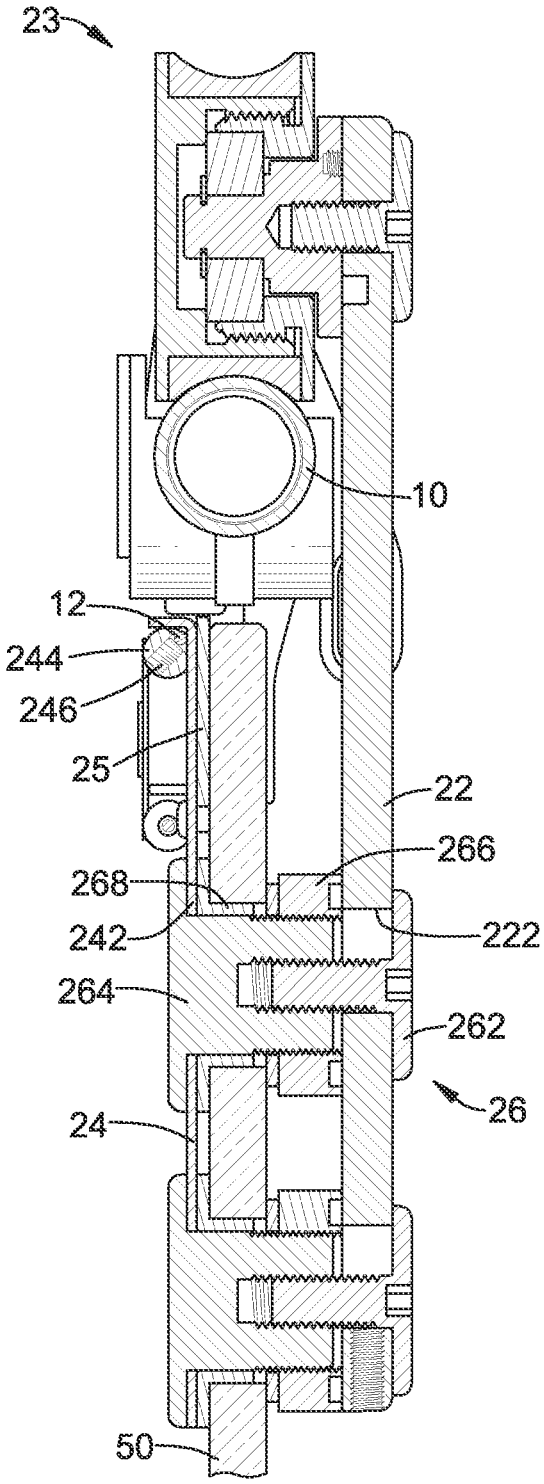
FIG. 6 is an enlarged side view in partial section of the driving device in FIG. 1.
Figure 7:
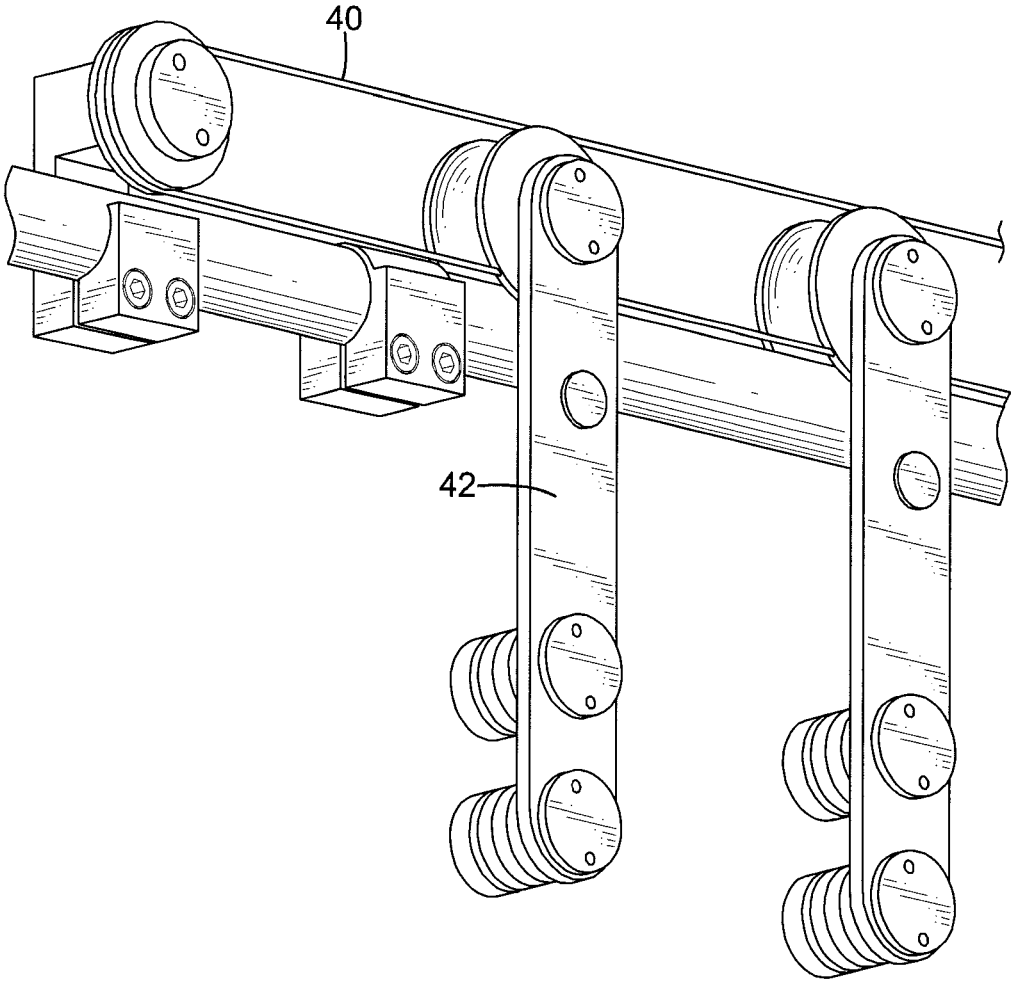
FIG. 7 PRIOR ART
FIG. 7 is a partial perspective view of a conventional driving device for two door panels in accordance with the prior art.

With further reference to FIGS. 4 to 6, the rear clamping panel 24 is connected securely to the front clamping panel 22 and the cord 12 and is mounted on the inner side of the corresponding door panel 50, such that the front and rear claming panels 22,24 clamp respectively onto two sides of the corresponding door panel 50. Preferably, the rear clamping panel 24 has a length shorter than that of the front clamping panel 22. The rear clamping panel 24 may further have at least one combining hole 242, a soft gasket 25 and a cord mount 244. The at least one combining hole 242 is defined through the rear clamping panel 24 and corresponds respectively to the at least one through hole 222 in the front clamping panel 22. The soft gasket 25 is mounted near a top of the rear clamping panel 24 at a side facing the front clamping panel 22 and abuts with the corresponding door panel 50. The cord mount 244 is formed on a side of the rear clamping panel 24 opposite to the front clamping panel 22, is mounted around the cord 12 and has a curved cross section and a cord fastener 246 mounted in the cord mount and abutting against or being inserted into the cord 12. With the arrangement of the cord mount 244 and the cord fastener 246, the rear clamping panel 24 is securely connected to the cord 12, and the clamping assembly 20 is moved with the cord 12 relative to the rail rod 10. To connect respectively to the two door panels 50, the clamping assemblies 20 corresponding to the door panels 50 are connected respectively to the upper segment and the lower segment of the cord 12. Accordingly, when the cord 12 is driven and moved by a motor or by manually pushing one of the door panels 50, the door panels 50 can be synchronously moved in opposite directions to be opened or closed via the transmission of the clamping assemblies 20.

The at last one fastener assembly 26 is mounted respectively through the at least one through hole 222 in the front clamping panel 22 and the at least one combining hole 242 in the rear clamping panel 24 to securely connect the front and rear clamping panels 22,24 with each other. Each fastener assembly 26 comprises a front fastening bolt 262, a rear fastening bolt 264, a front securing nut 266 and a rear securing collar 268. The front fastening bolt 262 is mounted in one of the at least one through hole 222 in the front clamping panel 22 and has a disk head and a threaded shank protruding from the head and mounted through a corresponding through hole 222. The rear fastening bolt 264 is mounted in one of the at least one combining hole 242 in the rear clamping panel 24 and has a disk head and a threaded shank. The threaded shank protrudes from the head, is mounted through a corresponding combining hole 242 and has a free end, a threaded hole and an outer thread. The threaded hole is defined in the free end and is screwed with the threaded shank of the front fastening bolt 262. The outer thread is formed around the threaded shank of the rear fastening bolt 264. The front securing nut 266 is mounted on the front clamping panel 22 at a side facing the rear clamping panel 24, is mounted around and screwed with the outer thread on the threaded shank of the rear fastening bolt 264 and abuts with the outer side of the corresponding door panel 50. The rear securing collar 268 is mounted around the threaded shank of the rear fastening bolt 264 and abuts with the inner side of the corresponding door panel 50. With the arrangement of the front securing nut 266 and the rear securing collar 268, the front and rear clamping panels 22,24 are separated from the sides of the corresponding door panel 50.

Accordingly, because the cord 12 is connected to the rear clamping panels 24 that are mounted on the inner sides of the door panels 50, the conjunction positions between the cord 12 and the clamping assemblies 20 are hidden at the inner sides of the door panels 50 and are not visible from the outer sides of the door panels 50. Consequently, the aesthetic appearance of the door panels 50 is not badly influenced due to the arrangement of the driving device, such that the appearance design of the door panels is versatile.

Furthermore, the front clamping panel 22 and the rear clamping panel 24 of each clamping assembly 20 are two individual parts, separated from each other and connected respectively to the outer and inner sides of a corresponding door panel 50, the rear clamping panel 24, even the cord 12 can be selectively omitted to fit with manual and non-synchronous driving design to the two door panels. On the contrary, the rear clamping panel 24 and the cord 12 can be selectively added into an existed driving device having only the front clamping panels 22 in a manual and non-synchronous driving design. Accordingly, the use of the driving device in accordance with the present invention is convenient and versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving device for driving two door panels to synchronously move comprising:

a rail rod having two wheels mounted respectively on two ends of the rail rod;

a cord mounted between and around the wheels on the rail rod, being parallel to the rail rod and adapted to be mounted at a position at inner sides of the door panels; and multiple clamping assemblies securely connected to the cord, moveable relative to the rail rod and adapted to clamp the door panels, and each clamping assembly comprising a front clamping panel adapted to be mounted on an outer side of a corresponding one of the door panels; and a rear clamping panel adapted to be mounted on the inner side of the corresponding door panel and connected securely to the front clamping panel and the cord, wherein each clamping assembly further has at least one through hole defined through the front clamping panel of the clamping assembly;

at least one combining hole defined through the rear clamping panel of the clamping assembly and corresponding respectively to the at least one through hole in the front clamping panel; and at least one fastener assembly mounted respectively through the at least one through hole in the front clamping panel and the at least one combining hole in the rear clamping panel to securely connect the front and rear clamping panels with each other;

the rear clamping panel of each clamping assembly further has a cord mount formed on a side of the rear clamping panel opposite to the front clamping panel of the clamping assembly; and the cord mount on the rear clamping panel of each clamping assembly is mounted around the cord and has a curved cross section and a cord fastener mounted in the cord mount and abutting against the cord.

2. The driving device as claimed in claim 1, wherein the cord is mounted at a position below the rail rod.

3. The driving device as claimed in claim 2, wherein the front clamping panel of each clamping assembly further has a roller rotatably mounted on a top at an inner side of the front clamping panel and mounted over a top of the rail rod.

4. The driving device as claimed in claim 3, wherein the rear clamping panel of each clamping assembly has a length shorter than that of the front clamping panel of the clamping assembly.

5. The driving device as claimed in claim 4, wherein the rear clamping panel of each clamping assembly further has a gasket mounted near a top of the rear clamping panel at a side facing the front clamping panel of the clamping assembly and adapted to abut with the corresponding door panel.

6. The driving device as claimed in claim 5, wherein each one of the at least one fastener assembly of each clamping assembly comprises a front fastening bolt mounted in one of the at least one through hole in the front clamping panel of the clamping assembly and having a disk head and a threaded shank protruding from the head and mounted through a corresponding through hole;

a rear fastening bolt mounted in one of the at least one combining hole in the rear clamping panel of the clamping assembly and having a disk head; and a threaded shank protruding from the head, mounted through a corresponding combining hole and having a free end;

a threaded hole defined in the free end and screwed with the threaded shank of the front fastening bolt; and an outer thread formed around the threaded shank of the rear fastening bolt; and a front securing nut mounted on the front clamping panel of the clamping assembly at a side facing the rear clamping panel of the clamping assembly and mounted around and screwed with the outer thread on the threaded shank of the rear fastening bolt; and a rear securing collar mounted around the threaded shank of the rear fastening bolt.

7. The driving device as claimed in claim 1, wherein the front clamping panel of each clamping assembly further has a roller rotatably mounted on a top at an inner side of the front clamping panel and mounted over a top of the rail rod.

8. The driving device as claimed in claim 1, wherein the rear clamping panel of each clamping assembly has a length shorter than that of the front clamping panel of the clamping assembly.

9. The driving device as claimed in claim 1, wherein the rear clamping panel of each clamping assembly further has a gasket mounted near a top of the rear clamping panel at a side facing the front clamping panel of the clamping assembly and adapted to abut with the corresponding door panel.

10. The driving device as claimed in claim 1, wherein each one of the at least one fastener assembly of each clamping assembly comprises a front fastening bolt mounted in one of the at least one through hole in the front clamping panel of the clamping assembly and having a disk head and a threaded shank protruding from the head and mounted through a corresponding through hole;

a rear fastening bolt mounted in one of the at least one combining hole in the rear clamping panel of the clamping assembly and having a disk head; and a threaded shank protruding from the head, mounted through a corresponding combining hole and having a free end;

a threaded hole defined in the free end and screwed with the threaded shank of the front fastening bolt; and an outer thread formed around the threaded shank of the rear fastening bolt; and a front securing nut mounted on the front clamping panel of the clamping assembly at a side facing the rear clamping panel of the clamping assembly and mounted around and screwed with the outer thread on the threaded shank of the rear fastening bolt; and a rear securing collar mounted around the threaded shank of the rear fastening bolt.

11. A driving device for driving two door panels to synchronously move comprising:

a rail rod having two wheels mounted respectively on two ends of the rail rod;

a cord mounted between and around the wheels on the rail rod, being parallel to the rail rod and adapted to be mounted at a position at inner sides of the door panels; and multiple clamping assemblies securely connected to the cord, moveable relative to the rail rod and adapted to clamp the door panels, and each clamping assembly comprising a front clamping panel adapted to be mounted on an outer side of a corresponding one of the door panels; and a rear clamping panel adapted to be mounted on the inner side of the corresponding door panel and connected securely to the front clamping panel and the cord, wherein each clamping assembly further has at least one through hole defined through the front clamping panel of the clamping assembly;

at least one combining hole defined through the rear clamping panel of the clamping assembly and corresponding respectively to the at least one through hole in the front clamping panel; and at least one fastener assembly mounted respectively through the at least one through hole in the front clamping panel and the at least one combining hole in the rear clamping panel to securely connect the front and rear clamping panels with each other;

the rear clamping panel of each clamping assembly further has a cord mount formed on a side of the rear clamping panel opposite to the front clamping panel of the clamping assembly; and each one of the at least one fastener assembly of each clamping assembly comprises a front fastening bolt mounted in one of the at least one through hole in the front clamping panel of the clamping assembly and having a disk head and a threaded shank protruding from the head and mounted through a corresponding through hole;

a rear fastening bolt mounted in one of the at least one combining hole in the rear clamping panel of the clamping assembly and having a disk head; and a threaded shank protruding from the head, mounted through a corresponding combining hole and having a free end;

a threaded hole defined in the free end and screwed with the threaded shank of the front fastening bolt; and an outer thread formed around the threaded shank of the rear fastening bolt; and a front securing nut mounted on the front clamping panel of the clamping assembly at a side facing the rear clamping panel of the clamping assembly and mounted around and screwed with the outer thread on the threaded shank of the rear fastening bolt; and a rear securing collar mounted around the threaded shank of the rear fastening bolt.

* * * * *